US011767572B1

(12) United States Patent
Sung

(10) Patent No.: US 11,767,572 B1
(45) Date of Patent: Sep. 26, 2023

(54) ALLOY STEEL HAVING EXCELLENT HYDROGEN EMBRITTLEMENT RESISTANCE AND STRENGTH AND METHOD OF MANUFACTURING SAME

(71) Applicants: Hyundai Motor Company, Seoul (KR); Kia Corporation, Seoul (KR)

(72) Inventor: Hyun Je Sung, Gyeonggi-do (KR)

(73) Assignees: Hyundai Motor Company, Seoul (KR); Kia Corporation, Seoul (KR)

( * ) Notice: Subject to any disclaimer, the term of this patent is extended or adjusted under 35 U.S.C. 154(b) by 0 days.

(21) Appl. No.: 18/072,382

(22) Filed: Nov. 30, 2022

(30) Foreign Application Priority Data

Jun. 15, 2022 (KR) ..... 10-2022-0072992

(51) Int. Cl.

| | |
|---|---|
| ***C22C 38/52*** | (2006.01) |
| ***C21D 9/00*** | (2006.01) |
| ***C22C 38/50*** | (2006.01) |
| ***C22C 38/48*** | (2006.01) |
| ***C22C 38/46*** | (2006.01) |
| ***C22C 38/44*** | (2006.01) |
| ***C22C 38/42*** | (2006.01) |
| ***C22C 38/06*** | (2006.01) |
| ***C22C 38/04*** | (2006.01) |
| ***C22C 38/02*** | (2006.01) |
| ***C22C 38/00*** | (2006.01) |
| ***C21D 6/00*** | (2006.01) |
| ***C22C 38/54*** | (2006.01) |

(52) U.S. Cl.

CPC ..... *C21D 9/0081* (2013.01); *C21D 6/004* (2013.01); *C21D 6/005* (2013.01); *C21D 6/007* (2013.01); *C21D 6/008* (2013.01); *C22C 38/002* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *C21D 2211/008* (2013.01)

(58) Field of Classification Search

CPC .... B21D 35/002; B21D 35/001; B65D 41/16; Y02E 60/10; Y02E 60/32; C21D 9/46; C21D 9/14; C21D 9/08; C21D 8/0247; C21D 8/0263; C21D 1/26; C21D 1/18; C22C 38/002; C22C 38/005; C22C 38/02; C22C 38/04; C22C 38/06; C22C 38/16; C22C 38/42; C22C 38/44; C22C 38/46; C22C 38/48; C22C 38/50; C22C 38/54; F17C 2203/0639; F17C 2221/012; F17C 1/14

USPC ..... 420/91

See application file for complete search history.

(56) References Cited

FOREIGN PATENT DOCUMENTS

| | | | | |
|---|---|---|---|---|
| JP | 2018012856 | A | * | 1/2018 |
| KR | 10-2015-0119952 | A | | 10/2015 |
| KR | 10-2015-0125986 | A | | 11/2015 |
| KR | 10-2020-0038327 | A | | 4/2020 |
| KR | 10-20210094029 | A | | 7/2021 |
| KR | 10-2022-0018779 | A | | 2/2022 |

OTHER PUBLICATIONS

NPL: on-line translation of JP 2018012856 A, Jan. 2018 (Year: 2018).*

* cited by examiner

*Primary Examiner* — Jie Yang

(74) *Attorney, Agent, or Firm* — Fox Rothschild LLP

(57) ABSTRACT

Disclosed are an alloy steel including boron (B) to provide improved hardenability, cobalt (Co) to provide improve strength, and the method of preparing the alloy steel. In particular, components of the alloy steel composition are appropriately mixed to form 100 vol % of tempered martensite as a constituent structure, thereby exhibiting excellent hydrogen embrittlement resistance and strength.

9 Claims, No Drawings

ALLOY STEEL HAVING EXCELLENT HYDROGEN EMBRITTLEMENT RESISTANCE AND STRENGTH AND METHOD OF MANUFACTURING SAME

CROSS-REFERENCE TO RELATED APPLICATION

This application claims, under 35 U.S.C. § 119(a), the benefit of priority from Korean Patent Application No. 10-2022-0072992, filed on Jun. 15, 2022, the entire contents of which are incorporated herein by reference.

TECHNICAL FIELD

The present disclosure relates to alloy steel having excellent hydrogen embrittlement resistance and strength and a method of manufacturing the same.

BACKGROUND

In line with the depletion of fossil fuels and the rise of environmental problems, countries have prepared to expand hydrogen energy in earnest by announcing a roadmap to revitalize the hydrogen energy industry. In the hydrogen energy industry, each local government is primarily distributing and supporting hydrogen electric vehicles, and accordingly, the need to build infrastructure such as hydrogen fueling stations has been increased. In particular, the "accumulator" in the hydrogen fueling station serves to pressurize the hydrogen fuel tank at a greater pressure than the charging pressure for differential-pressure hydrogen charging into the hydrogen fuel tank of a hydrogen electric vehicle. Since the charging pressure of a hydrogen electric vehicle is 700 bar, the accumulator must withstand a greater pressure than that. STS316L or alloy steel may be applied to the accumulator, but STS has low strength such as tensile strength of 500-600 MPa and is very expensive. Although ductility, notch strength, and toughness of alloy steel may be reduced in a hydrogen gas atmosphere, when hydrogen embrittlement resistance is improved, safety and cost reduction of the accumulator may be satisfied at the same time, so development thereof is actively required.

SUMMARY

In preferred aspects, provided are an alloy steel having excellent hydrogen embrittlement resistance and strength and a method of manufacturing the same.

The objects of the present invention are not limited to the foregoing. The objects of the present invention will be able to be clearly understood through the following description and to be realized by the means described in the claims and combinations thereof.

In an aspect, the disclosure provides alloy steel composition including, an amount of about 0.2 wt % to 0.5 wt % of carbon (C), an amount of about 0.1 wt % to 0.5 wt % of silicon (Si), an amount of about 0.6 wt % to 0.9 wt % of manganese (Mn), an amount of about 0.001 wt % to 0.03 wt % of phosphorus (P), an amount of about 0.001 wt % to 0.01 wt % of sulfur (S), an amount of about 0.001 wt % to 0.1 wt % of aluminum (Al), an amount of about 0.001 wt % to 0.3 wt % of copper (Cu), an amount of about 0.6 wt % to 2.5 wt % of chromium (Cr), an amount of about 0.001 wt % to 0.5 wt % of nickel (Ni), an amount of about 0.05 wt % to 1.0 wt % of molybdenum (Mo), an amount of about 0.01 wt % to 0.3 wt % of vanadium (V), an amount of about 0.01 wt % to 0.1 wt % of niobium (Nb), an amount of about 0.01 wt % to 0.1 wt % of titanium (Ti), an amount of about 0.001 wt % to 0.005 wt % of calcium (Ca), an amount of about 0.001 wt % to 0.005 wt % of magnesium (Mg), an amount of about 0.001 wt % to 0.01 wt % of oxygen (O), an amount of about 0.001 wt % to 0.015 wt % of nitrogen (N), an amount of about 0.01 wt % to 0.02 wt % of boron (B), an amount of about 0.01 wt % to 0.1 wt % of cobalt (Co), and the remainder of iron (Fe) and other unavoidable impurities. All the wt % are based on the total weight of the alloy steel composition. The alloy steel may have a microstructure including tempered martensite, and the fraction of the tempered martensite may be 100 vol % at a temperature of about 15° C. to 25° C. based on an area fraction.

The alloy steel may include precipitates including V(C,N), Nb(C,N), Ti(C,N), or combinations thereof, a number of the precipitates may be about 20 or greater per area ($\mu m^2$), and the precipitates may have a diameter of about 20 nm or less in a microstructure thereof.

The diameter as used herein may be a maximum distance measured between the two points on each precipitate.

The alloy steel may have tensile strength of about 1000 MPa or more.

The alloy steel may satisfy Relation 1 below:

$$\text{Notch tensile strength ratio (MPa)} \times \text{tensile strength (GPa)} \geq 0.75, \quad \text{[Relation 1]}$$

wherein, in the Relation 1, the notch tensile strength ratio is the value obtained by dividing a notch tensile strength in a hydrogen-charged atmosphere by a notch tensile strength in a general ambient atmosphere.

In an aspect, the disclosure provides a method of manufacturing alloy steel, providing an alloy steel slab including, based on the total weight thereof, an amount of about 0.2 wt % to 0.5 wt % of carbon (C), an amount of about 0.1 wt % to 0.5 wt % of silicon (Si), an amount of about 0.6 wt % to 0.9 wt % of manganese (Mn), an amount of about 0.001 wt % to 0.03 wt % of phosphorus (P), an amount of about 0.001 wt % to 0.01 wt % of sulfur (S), an amount of about 0.001 wt % to 0.1 wt % of aluminum (Al), an amount of about 0.001 wt % to 0.3 wt % of copper (Cu), an amount of about 0.6 wt % to 2.5 wt % of chromium (Cr), an amount of about 0.001 wt % to 0.5 wt % of nickel (Ni), an amount of about 0.05 wt % to 1.0 wt % of molybdenum (Mo), an amount of about 0.01 wt % to 0.3 wt % of vanadium (V), an amount of about 0.01 wt % to 0.1 wt % of niobium (Nb), an amount of about 0.01 wt % to 0.1 wt % of titanium (Ti), an amount of about 0.001 wt % to 0.005 wt % of calcium (Ca), an amount of about 0.001 wt % to 0.005 wt % of magnesium (Mg), an amount of about 0.001 wt % to 0.01 wt % of oxygen (O), an amount of about 0.001 wt % to 0.015 wt % of nitrogen (N), an amount of about 0.01 wt % to 0.02 wt % of boron (B), an amount of about 0.01 wt % to 0.1 wt % of cobalt (Co), and the remainder of iron (Fe) and other unavoidable impurities; primary heat treating the alloy steel slab; manufacturing an alloy steel by secondary heat treating the alloy steel slab at a temperature equal to or higher than an A3 transformation point; austenitizing the alloy steel by subjecting the alloy steel to cooling, third heat treating, and maintenance, cooling the austenitized alloy steel; and tempering the cooled alloy steel by fourth heat treating.

The cooling the austenitized alloy steel may be performed through a quenching process.

The method may further include performing cooling the alloy steel to a temperature of about to about 15° C. to 25° C., after the tempering.

The alloy steel may have a microstructure comprising tempered martensite, and a fraction of the tempered martensite is 100 vol % at a temperature of about 15° C. to 25° C. based on an area fraction.

The alloy steel may include precipitates including V(C, N), Nb(C,N), Ti(C,N), or combinations thereof, a number of the precipitates may be about 20 or greater per area ($\mu m^2$), and the precipitates may have a diameter of about 20 nm or less in a microstructure thereof.

The alloy steel may suitably have a tensile strength of about 1000 MPa or greater.

The alloy steel satisfies Relation 1 below:

$$\text{Notch tensile strength ratio (MPa)} \times \text{tensile strength (GPa)} \geq 0.75 \quad \text{[Relation 1]}$$

wherein in the Relation 1, the notch tensile strength ratio is a value obtained by dividing a notch tensile strength in a hydrogen-charged atmosphere by a notch tensile strength in a general ambient atmosphere.

Also provided is a vehicle including the alloy steel composition or the alloy steel as described herein.

Other aspects of the invention are disclosed infra.

DETAILED DESCRIPTION

The above and other objects, features and advantages of the present invention will be more clearly understood from the following preferred embodiments taken in conjunction with the accompanying drawings. However, the present invention is not limited to the embodiments disclosed herein, and may be modified into different forms. These embodiments are provided to thoroughly explain the disclosure and to sufficiently transfer the spirit of the present invention to those skilled in the art.

Throughout the drawings, the same reference numerals will refer to the same or like elements. For the sake of clarity of the present invention, the dimensions of structures are depicted as being larger than the actual sizes thereof. It will be understood that, although terms such as "first", "second", etc. may be used herein to describe various elements, these elements are not to be limited by these terms. These terms are only used to distinguish one element from another element. For instance, a "first" element discussed below could be termed a "second" element without departing from the scope of the present invention. Similarly, the "second" element could also be termed a "first" element. As used herein, the singular forms are intended to include the plural forms as well, unless the context clearly indicates otherwise.

It will be further understood that the terms "comprise", "include", "have", etc., when used in this specification, specify the presence of stated features, integers, steps, operations, elements, components, or combinations thereof, but do not preclude the presence or addition of one or more other features, integers, steps, operations, elements, components, or combinations thereof. Also, it will be understood that when an element such as a layer, film, area, or sheet is referred to as being "on" another element, it may be directly on the other element, or intervening elements may be present therebetween. Similarly, when an element such as a layer, film, area, or sheet is referred to as being "under" another element, it may be directly under the other element, or intervening elements may be present therebetween.

Unless otherwise specified, all numbers, values, and/or representations that express the amounts of components, reaction conditions, polymer compositions, and mixtures used herein are to be taken as approximations including various uncertainties affecting measurement that inherently occur in obtaining these values, among others, and thus should be understood to be modified by the term "about" in all cases. Further, unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Furthermore, when a numerical range is disclosed in this specification, the range is continuous, and includes all values from the minimum value of said range to the maximum value thereof, unless otherwise indicated. Moreover, when such a range pertains to integer values, all integers including the minimum value to the maximum value are included, unless otherwise indicated. In the present specification, when a range is described for a variable, it will be understood that the variable includes all values including the end points described within the stated range. For example, the range of "5 to 10" will be understood to include any subranges, such as 6 to 10, 7 to 10, 6 to 9, 7 to 9, and the like, as well as individual values of 5, 6, 7, 8, 9 and 10, and will also be understood to include any value between valid integers within the stated range, such as 5.5, 6.5, 7.5, 5.5 to 8.5, 6.5 to 9, and the like. Also, for example, the range of "10% to 30%" will be understood to include subranges, such as 10% to 15%, 12% to 18%, 20% to 30%, etc., as well as all integers including values of 10%, 11%, 12%, 13% and the like up to 30%, and will also be understood to include any value between valid integers within the stated range, such as 10.5%, 15.5%, 25.5%, and the like.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

In an aspect, provided is an alloy steel or an alloy steel composition including, based on the total weight thereof, carbon (C), silicon (Si), manganese (Mn), phosphorus (P), sulfur (S), aluminum (Al), copper (Cu), chromium (Cr), nickel (Ni), molybdenum (Mo), vanadium (V), niobium (Nb), titanium (Ti), calcium (Ca), magnesium (Mg), oxygen (O), nitrogen (N), boron (B), cobalt (Co), and the remainder of iron (Fe) and other unavoidable impurities.

Typically, when the tensile strength of alloy steel exceeds 1000 MPa in a general ambient atmosphere, hydrogen embrittlement resistance thereof decreases rapidly. Therefore, it is important to maintain and increase hydrogen embrittlement resistance even in ultra-high strength alloy steel having tensile strength greater than 1000 MPa, and the present invention pertains to alloy steel having excellent hydrogen embrittlement resistance and tensile strength.

Hereinafter, alloy steel, which is an aspect of the present invention, will be described in detail.

Carbon (C) Carbon (C) may be an austenite-stabilizing element, which is capable of controlling the A3 temperature and the martensite formation initiation temperature (Ms) depending on the amount thereof. Also, carbon may be an interstitial element and very effective at attaining strong strength by applying asymmetric distortion to the lattice structure of martensite. Therefore, carbon may be an essential element for ensuring hardenability and a martensite structure.

Carbon (C) may be included in an amount of about 0.2 wt % to 0.5 wt % based on the total weight of alloy steel or its composition. Here, when the amount of carbon (C) is less than about 0.2 wt %, the above-described effect cannot be sufficiently obtained, whereas if the amount thereof is greater than about 0.5 wt %, impact toughness and weldability may be greatly deteriorated due to excessive formation of carbides or excessive hardening.

Silicon (Si)

Silicon (Si) may be an element that is added as a deoxidizer during casting as well as solid solution strengthening. Although silicon (Si) serves to suppress the formation of carbonitrides, it may improve hydrogen embrittlement resistance and impact properties by forming fine carbonitrides.

Silicon (Si) may be included in an amount of about 0.1 wt % to 0.5 wt % based on the total weight of alloy steel. When the amount of silicon (Si) is less than about 0.1 wt %, the above-described effect cannot be sufficiently obtained, whereas if the amount thereof is greater than about 0.5 wt %, there may occur problems in the formation of beneficial fine carbonitrides.

Manganese (Mn)

Manganese (Mn) may be an austenite-stabilizing element, and may greatly improve the hardenability of alloy steel so that a hard phase such as martensite may be formed. Manganese may also react with sulfur to precipitate MnS, which may prevent high-temperature cracking caused by sulfur segregation.

Manganese (Mn) may be included in an amount of about 0.6 wt % to 0.9 wt % based on the total weight of alloy steel. When the amount of manganese (Mn) is less than about 0.6 wt %, the above-described effect cannot be sufficiently obtained, whereas if the amount thereof is greater than about 0.9 wt %, austenite stability may increase excessively and segregation problems may occur during casting.

Phosphorus (P)

Phosphorus (P) may be an element showing a solid solution strengthening effect.

Phosphorus (P) may be included in an amount of about 0.001 wt % to 0.03 wt % based on the total weight of alloy steel. When the amount of phosphorus (P) is greater than about 0.03 wt %, phosphorus (P), which is an impurity element unavoidably contained in alloy steel, may cause brittleness in the alloy steel by grain boundary segregation and may reduce weldability.

Sulfur (5)

Sulfur (S) may be an impurity element unavoidably contained in alloy steel.

Sulfur (S) may be included in an amount of about 0.001 wt % to 0.01 wt % based on the total weight of alloy steel. When the amount of sulfur (S) is greater than about 0.01 wt %, ductility and weldability of the alloy steel may be reduced.

Aluminum (Al)

Aluminum (Al) may be an element that expands the ferrite region and may serve as a strong deoxidizer during casting.

Aluminum (Al) may be included in an amount of about 0.001 wt % to 0.1 wt % based on the total weight of alloy steel. When the amount of aluminum (Al) is greater than about 0.1 wt %, the A3 temperature may rise excessively when increasing the amount of aluminum (Al) because elements effective for stabilizing ferrite, such as chromium (Cr), are included in the present invention, in addition to aluminum (Al), which may cause processing inefficiency with an increase in the heat treatment temperature, and moreover, a large amount of oxide-based inclusions may be formed, which may adversely affect hydrogen embrittlement resistance.

Copper (Cu)

Copper (Cu) may be an element that increases hardenability of the material, and may form a uniform structure in the alloy steel after heat treatment.

Copper (Cu) may be included in an amount of about 0.001 wt % to 0.3 wt % based on the total weight of alloy steel. Here, if the amount of copper (Cu) is greater than about 0.3 wt %, possibility of cracking in the alloy steel may increase.

Chromium (Cr)

Chromium (Cr) may be a representative ferrite-stabilizing element and may increase hardenability. Depending on the amount thereof, the A3 temperature and the delta ferrite formation temperature are adjusted. Chromium (Cr) reacts with oxygen (O) to form a dense and stable protective film of $Cr_2O_3$, thereby improving corrosion resistance in a hydrogen environment.

Chromium (Cr) may be included in an amount of about 0.6 wt % to 2.5 wt % based on the total weight of alloy steel. When the amount of chromium (Cr) is less than about 0.6 wt %, effects such as improvement of hardenability and corrosion resistance by chromium (Cr) cannot be sufficiently obtained. When the amount thereof is greater than about 2.5 wt %, chromium (Cr) widens the delta ferrite formation temperature range, and thus the higher the amount thereof, the wider the temperature range in which delta ferrite remains during casting of alloy steel, and moreover, delta ferrite remains unremoved even after heat treatment, which consequently may adversely affect the properties of alloy steel. Hence, in order to suppress the formation of delta ferrite, the amount of Cr may be limited to about 2.5 wt % or less.

Nickel (Ni)

Nickel (Ni) may be an element that improves the toughness of alloy steel and may increase strength of alloy steel without deterioration of low-temperature toughness. Also, when nickel (Ni) is added, it is possible to effectively prevent a problem such as a decrease in matrix strength due to the formation of ferrite, pearlite, and bainite structures by increasing hardenability. Also, hydrogen embrittlement resistance may be improved by suppressing hydrogen diffusion into alloy steel.

Nickel (Ni) may be included in an amount of about 0.001 wt % to 0.5 wt % based on the total weight of alloy steel. When the amount of nickel (Ni) is greater than about 0.5 wt %, nickel (Ni) is an expensive element, and thus the manufacturing cost may be greatly increased, which is undesirable.

Molybdenum (Mo)

Molybdenum (Mo) may increase the hardenability of alloy steel and is a ferrite-stabilizing element. Also, molybdenum (Mo) may be an essential element for strengthening steel materials through a strong solid solution strengthening effect and for strengthening grain boundaries and thus may help to improve hydrogen embrittlement resistance.

Molybdenum (Mo) may be included in an amount of about 0.05 wt % to 1.0 wt % based on the total weight of alloy steel. When the amount of molybdenum (Mo) is less than about 0.05 wt %, the above-described effect cannot be sufficiently obtained, whereas if the amount thereof is greater than about 1.0 wt %, delta ferrite may remain after casting the alloy steel by widening the temperature range that forms the delta ferrite, which is undesirable.

Vanadium (V)

Vanadium (V) may be an element that increases hardenability, enhances strength by forming fine V(C,N) carbonitrides, and improves hydrogen embrittlement resistance by trapping diffused hydrogen.

Vanadium (V) may be included in an amount of about 0.01 wt % to 0.3 wt % based on the total weight of alloy steel. When the amount of vanadium (V) is less than about 0.01 wt %, the above-described effect cannot be sufficiently obtained, whereas if the amount thereof is greater than about 0.3 wt %, the mechanical properties of the weld may be deteriorated or the production process may be problematic.

Niobium (Nb)

Niobium (Nb) may be an element that enhances strength by forming fine Nb(C,N) carbonitrides and may improve hydrogen embrittlement resistance by trapping diffused hydrogen. Also, upon reheating of alloy steel, niobium is in a state of a solid solution and suppresses the growth of austenite grains during hot deformation, and then precipitates to enhance strength of the alloy steel.

Niobium (Nb) may be included in an amount of about 0.01 wt % to 0.1 wt % based on the total weight of alloy steel. When the amount of niobium (Nb) is less than about 0.01 wt %, the above-described effect cannot be sufficiently obtained. When the amount thereof is greater than about 0.1 wt %, weldability may be deteriorated, and grains may become excessively fine.

Titanium (Ti)

Titanium (Ti) may be an element that enhances strength by forming fine Ti(C,N) carbonitrides and may improve hydrogen embrittlement resistance by trapping diffused hydrogen, and is effective at suppressing grain growth by itself. Also, titanium may bind with nitrogen (N) at an ultra-high temperature instead of boron (B), thus preventing boron (B) from forming BN, and is in a state of a solid solution in alloy steel and may thus help to exhibit beneficial effects such as strengthening grain boundaries and increasing hardenability.

Titanium (Ti) may be included in an amount of about 0.01 wt % to 0.1 wt % based on the total weight of alloy steel. When the amount of titanium (Ti) is less than about 0.01 wt %, the above-described effect cannot be sufficiently obtained, whereas if the amount thereof is greater than about 0.1 wt %, it may adversely affect the toughness of the weld heat-affected zone.

Calcium (Ca)

Calcium (Ca) may react with elemental sulfur (S) to form CaS. Since calcium exhibits a spherical shape, instead of MnS that is easily stretched in the rolling direction, calcium functions to control the form of sulfide-based inclusions.

Calcium (Ca) may be included in an amount of about 0.001 wt % to 0.005 wt % based on the total weight of alloy steel. When the amount of calcium (Ca) is greater than about 0.005 wt %, cleanliness of the molten metal may be lowered, and thus toughness may be deteriorated.

Magnesium (Mg)

Magnesium (Mg) may be used as a desulfurization agent similarly to calcium (Ca).

Magnesium (Mg) may be included in an amount of about 0.001 wt % to 0.005 wt % based on the total weight of alloy steel. When the amount of magnesium (Mg) is greater than about 0.005 wt %, cleanliness of the molten metal may be lowered, and thus toughness may be deteriorated.

Oxygen (O)

Oxygen (O) may be included in an amount of about 0.001 wt % to 0.01 wt %, preferably about 0.001 wt % to 0.005 wt %, based on the total weight of alloy steel. When the amount of oxygen (O) is greater than about 0.01 wt %, the amounts of oxides such as alumina and the like and non-metallic inclusions may be increased, and thus ductility, toughness, and workability may be deteriorated.

Nitrogen (N)

Nitrogen (N) may be an element that may not be completely removed from the alloy steel industrially. Also, nitrogen (N) may form finer M(C,N) carbonitrides, rather than simple MC carbides.

Nitrogen (N) may be included in an amount of about 0.001 wt % to 0.015 wt % based on the total weight of alloy steel. When the amount of nitrogen (N) is greater than about 0.015 wt %, N may bind with boron (B) to form BN, and as such, possibility of occurrence of defects in the alloy steel may increase, which is undesirable.

Boron (B)

Boron (B) may be an element that is added to increase hardenability and strengthen grain boundaries. Boron (B) may be a ferrite-stabilizing element, and an alloying element that greatly contributes to an increase in hardenability even when present in a very small amount. Also, segregation thereof at the grain boundary causes a grain-boundary-strengthening effect. Also, the tendency of intergranular brittle fracture caused by hydrogen embrittlement in low-alloy steel may be reduced.

With excess amount of boron (B), BN may be formed and adversely affect the properties of alloy steel. When the amount of boron (B) is limited to a specific range and an appropriate mixing range thereof with other alloying elements is selected, boron (B) plays an effective role in increasing strength and improving hydrogen embrittlement resistance without degradation of mechanical properties.

Boron (B) may be included in an amount of about 0.001 wt % to 0.1 wt % (10 ppm to 1000 ppm), preferably about 0.01 wt % to 0.02 wt % (100 ppm to 200 ppm), based on the total weight of alloy steel. When the amount of boron (B) is less than about 0.01 wt %, the above-described effect cannot be sufficiently obtained, whereas if the amount thereof is greater than about 0.02 wt %, it may adversely affect the properties (ductility, toughness, etc.) of alloy steel.

Cobalt (Co)

Cobalt (Co) may be an element to realize ultra-high strength. For example, cobalt (Co) may have strengthening effect in a matrix and may improve corrosion resistance.

Conventional technology excludes the addition of cobalt (Co) because Co reduces hardenability and thus makes it impossible to obtain a martensite structure. In embodiments of the present disclosure, both cobalt (Co) for realizing ultra-high strength and boron (B) capable of very effectively increasing hardenability even in a small amount may be added, such that 100 vol % of martensite may be obtained as a constituent structure without loss of hardenability of alloy steel and also it is possible to achieve ultra-high strength such as tensile strength greater than about 1,000 MPa.

Cobalt (Co) may be included in an amount of about 0.001 wt % to 0.5 wt %, preferably about 0.01 wt % to 0.1 wt %, based on the total weight of alloy steel. When the amount of cobalt (Co) is less than about 0.01 wt %, the above-described effect cannot be sufficiently obtained. When the amount thereof is greater than about 0.1 wt %, hardenability of alloy steel may be lowered, such that the martensite structure may not be obtained in the process of cooling the alloy steel, which is austenitized by reheating, to room temperature through normalizing or quenching under specific conditions.

Remainder of Iron (Fe) and Other Unavoidable Impurities

The alloy steel may contain unavoidable impurities in a very small amount. The unavoidable impurities may be included in a very small amount so as not to affect properties such as strength, workability, durability, and the like of the alloy steel.

The alloy steel may have a microstructure including tempered martensite, and the fraction of tempered martensite may be 90 vol % or greater at a temperature of about 15° C. to 25° C. based on an area fraction. Preferably, the fraction of the tempered martensite is 98 vol % or greater, or 100 vol %. The precipitate may include V(C,N), Nb(C,N), Ti(C,N) or combinations thereof.

Martensite may have fine effective grains compared to other constituent structures. Also, carbon (C) and nitrogen (N) that are supersaturated in the alloy steel immediately after cooling the austenitized alloy steel during the process of manufacturing alloy steel bind with carbonitride-forming elements (e.g., vanadium (V), niobium (Nb), or titanium (Ti)) in the tempering step to form precipitates, but martensite has a higher dislocation density than other constituent structures, so carbonitrides may be more finely precipitated.

Consequently, when the vol % of martensite in the microstructure is high in the present invention, the tempered martensite may have finer effective grains than other constituent structures, and the precipitates capable of trapping hydrogen may be obtained in fine forms, such that hydrogen embrittlement resistance may be excellent.

The alloy steel may include precipitates in a number of about 20 or greater per area ($\mu m^2$) of having a diameter of about 20 nm or less in the microstructure thereof. There is no upper limit on the number of precipitates, but the upper limit thereof may be about 50 or less/$\mu m^2$. The hydrogen-trapping effect may be expected only when the alloy steel includes precipitates and a number of precipitates may be about 20 or greater per area ($\mu m^2$) and the precipitates may have a diameter of about 20 nm or less. When the number of precipitates having a diameter of 20 nm or less is less than about 20/$\mu m^2$, the distance between fine carbonitrides may be remarkably increased, and thus the effect of improving hydrogen embrittlement resistance as desired may not be obtained. On the other hand, when the number of the precipitates is greater than about 50/$\mu m^2$, ductility and toughness may become inferior.

The alloy steel according to the present invention may have tensile strength of about 1,000 MPa or greater. The tensile strength is obtained after performing a tensile test using the ASTM E8 standard, and is represented as an average value after three measurements.

The alloy steel according to the present invention may satisfy Relation 1 below.

$$\text{Notch tensile strength ratio (MPa)} \times \text{tensile strength (GPa)} \geq 0.75 \quad \text{[Relation 1]}$$

In the above Relation 1, the notch tensile strength ratio is the value obtained by dividing notch tensile strength in a hydrogen-charged atmosphere by notch tensile strength in a general ambient atmosphere.

The notch tensile strength ratio may be related to the notch tensile strength ratio specified in ASTM G142-98 and ANSI/CSA CHMC1 (RNTS=notch tensile strength in a hydrogen-charged atmosphere (MPa)÷notch tensile strength in a general ambient atmosphere (MPa)), and the greater the value, the better the hydrogen embrittlement resistance.

In particular, the relation that may intuitively determine both the hydrogen embrittlement resistance and the strength of the material is considered, and is the above [Relation 1] obtained by multiplying the notch tensile strength ratio (RNTS) value (MPa) by the tensile strength (GPa) of the alloy steel. When this value is about 0.75 or greater, it means that the hydrogen embrittlement resistance and the tensile strength of the alloy steel are excellent.

The disclosure also provides a method of manufacturing alloy steel.

In an aspect, provided is a method of manufacturing the alloy steel and the method includes steps of: providing an alloy steel slab including, based on the total weight thereof, an amount of about 0.2 wt % to 0.5 wt % of carbon (C), an amount of about 0.1 wt % to 0.5 wt % of silicon (Si), an amount of about 0.6 wt % to 0.9 wt % of manganese (Mn), an amount of about 0.001 wt % to 0.03 wt % of phosphorus (P), an amount of about 0.001 wt % to 0.01 wt % of sulfur (S), an amount of about 0.001 wt % to 0.1 wt % of aluminum (Al), an amount of about 0.001 wt % to 0.3 wt % of copper (Cu), an amount of about 0.6 wt % to 2.5 wt % of chromium (Cr), an amount of about 0.001 wt % to 0.5 wt % of nickel (Ni), an amount of about 0.05 wt % to 1.0 wt % of molybdenum (Mo), an amount of about 0.01 wt % to 0.3 wt % of vanadium (V), an amount of about 0.01 wt % to 0.1 wt % of niobium (Nb), an amount of about 0.01 wt % to 0.1 wt % of titanium (Ti), an amount of about 0.001 wt % to 0.005 wt % of calcium (Ca), an amount of about 0.001 wt % to 0.005 wt % of magnesium (Mg), an amount of about 0.001 wt % to 0.01 wt % of oxygen (O), an amount of about 0.001 wt % to 0.015 wt % of nitrogen (N), an amount of about 0.01 wt % to 0.02 wt % of boron (B), an amount of about 0.01 wt % to 0.1 wt % of cobalt (Co), and the remainder of iron (Fe) and other unavoidable impurities (S10); primary heating the alloy steel slab (S10); manufacturing an alloy steel by secondary heat treating the alloy steel slab at a temperature equal to or higher than the A3 transformation point (S20); austenitizing the alloy steel by subjecting the alloy steel to cooling, reheating, and maintenance (S30); cooling the austenitized alloy steel (S40); and tempering the cooled alloy steel through heat treatment (S50).

S10 may include steps of providing the alloy steel slab satisfying the alloy steel composition described above and primary heat treating the alloy steel slab. Here, the heating process facilitates the subsequent hot working process, and the temperature thereof is not particularly limited, but may be, for example, about 1000° C. to 1200° C.

S20 may include a step of manufacturing an alloy steel by secondary heating the heated alloy steel slab. The hot working may be hot rolling or hot forging. The hot working may be preferably performed at a temperature equal to or higher than the A3 transformation point. When the temperature is excessively high, austenite grains may become coarse, which is undesirable. Hence, it is possible to increase structural uniformity by carrying out the process at an austenite single-phase region temperature as described above.

S30 may include a step of an austenitization step in which the alloy steel is cooled, reheated (third heat treating), and then maintained.

The cooling may be performed through air cooling.

The reheating may be performed in a temperature range of about 850° C. to 950° C. When the reheating temperature is less than about 850° C., unintentional carbides formed in the cooling process after hot working may not be sufficiently re-dissolved. On the other hand, when the temperature is greater than about 950° C., the properties of the alloy steel may be inferior due to coarsening of the grains.

The austenitization time preferably falls in the range of about 1 to 2 hours. When the austenitization time is less than about 1 hour, unavoidable carbides formed in the cooling process after hot working may not be sufficiently re-dissolved. On the other hand, when the austenitization time is greater than about 2 hours, the properties of the steel may be inferior due to coarsening of the grains.

S40 may be a step of cooling the austenitized alloy steel.

The austenitized alloy steel may be cooled to a temperature ranging from about 15° C. to about 25° C. corresponding to room temperature at a cooling rate of about 0.5° C./s to about 20° C./s. The cooling step may be performed through quenching.

A martensite phase may be formed as an alloy steel structure through the cooling process. In this procedure, it is necessary to be careful not to generate ferrite and pearlite structures that greatly reduce matrix strength.

Since the alloy steel of the present invention contains elements favorable for increasing hardenability, such as chromium (Cr), molybdenum (Mo), boron (B), etc., it is preferable to suppress the generation of ferrite and pearlite by controlling the cooling rate. The cooling may be preferably performed at a cooling rate of about 0.5° C./s or greater, particularly 10° C./s or greater. When the cooling rate is greater than about 20° C./s, cracking may occur.

S50 may include a step of tempering in which the cooled alloy steel is heat-treated (fourth heat treating). The tempering step may be performed in a temperature range of about 600° C. to 650° C. When the tempering temperature is less than about 600° C., it may not be possible to induce the precipitation of fine carbonitrides within the heat treatment time due to the excessively low temperature. On the other hand, when the tempering temperature is greater than about 650° C., the material may be softened or the strength may be lowered through the formation of an unintended structure due to a dual-phase region.

The tempering step may be performed through heat treatment for 30 minutes or greater based on the alloy steel thickness of about 25 mm. When the time is less than about 30 minutes based on the steel sheet thickness of about 25 mm, heat may not be sufficiently transferred into the alloy steel, so the intended precipitate may not be properly formed. Since the above step may be performed for a time for which a target precipitate is sufficiently formed, the upper limit of the processing time is not particularly limited, but it is advantageous not to exceed 120 minutes.

Also, the thickness of the alloy steel provided in the present invention may preferably be about 25 to 100 mm.

The method of manufacturing the alloy steel may further include performing cooling to a temperature ranging from about 15° C. to about 25° C. corresponding to room temperature, after the tempering step. Here, the cooling may be performed through air cooling.

EXAMPLE

A better understanding of the present invention may be obtained through the following examples and comparative examples. However, these examples are not to be construed as limiting the technical spirit of the present invention.

Examples 1 to 7 and Comparative Examples 1 to 6

Alloy steel was manufactured under conditions described in Table 2 below using components in the amounts shown in Table 1 below.

Manufacturing Method

A steel slab of each of Examples and Comparative Examples was prepared, heated to a temperature of 1,000 1,200° C., and then finish hot-rolled at A3 or higher to obtain a hot-rolled steel sheet having a thickness of 30 mm. Thereafter, each hot-rolled steel sheet was reheated at various temperatures within the range of 850 to 950° C. for a period of time ranging from 1 hour to 2 hours and thus austenitized, followed by quenching and cooling to room temperature. Here, the cooling rate was about 10° C./s or greater. Each hot-rolled steel sheet thus cooled was tempered at various temperatures within the range of 600 to 650° C. for at least 30 minutes based on the steel sheet thickness of 25 mm, and then air-cooled to room temperature, thereby manufacturing final steel. Here, the tempering time was adjusted so as not to exceed 2 hours.

TABLE 1

| | Example [wt %] | | | | | | |
|---|---|---|---|---|---|---|---|
| Element | 1 | 2 | 3 | 4 | 5 | 6 | 7 |
| C | 0.21 | 0.33 | 0.44 | 0.45 | 0.48 | 0.47 | 0.48 |
| Si | 0.12 | 0.17 | 0.11 | 0.46 | 0.45 | 0.50 | 0.48 |
| Mn | 0.63 | 0.65 | 0.85 | 0.88 | 0.86 | 0.82 | 0.90 |
| P | 0.010 | 0.009 | 0.004 | 0.009 | 0.011 | 0.012 | 0.007 |
| S | 0.003 | 0.003 | 0.003 | 0.003 | 0.003 | 0.003 | 0.003 |
| Al | 0.004 | 0.003 | 0.006 | 0.004 | 0.005 | 0.008 | 0.008 |
| Cu | 0.15 | 0.26 | 0.21 | 0.15 | 0.23 | 0.28 | 0.28 |
| Cr | 0.7 | 2.1 | 2.3 | 2.4 | 2.3 | 2.3 | 2.4 |
| Ni | 0.3 | 0.4 | 0.4 | 0.4 | 0.4 | 0.4 | 0.4 |
| Mo | 0.10 | 0.50 | 0.49 | 0.45 | 0.55 | 0.78 | 0.94 |
| V | 0.02 | 0.05 | 0.16 | 0.22 | 0.28 | 0.30 | 0.30 |
| Nb | 0.03 | 0.05 | 0.07 | 0.10 | 0.06 | 0.04 | 0.10 |
| Ti | 0.02 | 0.04 | 0.05 | 0.08 | 0.09 | 0.09 | 0.10 |
| Ca | 0.004 | 0.003 | 0.002 | 0.003 | 0.002 | 0.001 | 0.004 |
| Mg | 0.004 | 0.005 | 0.002 | 0.003 | 0.003 | 0.001 | 0.002 |
| O | 0.005 | 0.004 | 0.005 | 0.003 | 0.002 | 0.004 | 0.003 |
| N | 0.001 | 0.007 | 0.013 | 0.012 | 0.014 | 0.008 | 0.013 |
| B [ppm] | 113 | 161 | 185 | 153 | 197 | 174 | 192 |
| Co | 0.02 | 0.04 | 0.05 | 0.07 | 0.10 | 0.07 | 0.06 |

TABLE 1-continued

| Element | Comp. Example [wt %] 1 | 2 | 3 | 4 | 5 | 6 |
|---|---|---|---|---|---|---|
| C | 0.24 | 0.25 | 0.39 | 0.43 | 0.21 | 0.21 |
| Si | 0.20 | 0.20 | 0.20 | 0.21 | 0.37 | 0.12 |
| Mn | 0.30 | 0.30 | 0.69 | 0.85 | 0.77 | 0.63 |
| P | 0.003 | 0.003 | 0.003 | 0.003 | 0.003 | 0.010 |
| S | 0.003 | 0.003 | 0.003 | 0.003 | 0.003 | 0.003 |
| Al | 0.008 | 0.008 | 0.003 | 0.004 | 0.005 | 0.004 |
| Cu | 0.10 | 0.12 | 0.20 | 0.03 | 0.05 | 0.15 |
| Cr | 1.2 | 0.9 | 1.5 | 1.6 | 1.8 | 0.7 |
| Ni | 0.9 | 0.7 | 1.9 | 1.1 | 0.6 | 0.3 |
| Mo | 0.60 | 0.59 | 0.59 | 0.48 | 0.81 | 0.10 |
| V | 0.01 | 0.01 | 0.01 | 0.21 | 0.13 | 0.02 |
| Nb | 0.05 | 0.10 | 0.09 | 0.08 | 0.04 | 0.03 |
| Ti | 0.01 | 0.01 | 0.01 | 0.01 | 0.01 | 0.02 |
| Ca | 0.001 | 0.003 | 0.004 | 0.003 | 0.002 | 0.004 |
| Mg | 0.004 | 0.002 | 0.002 | 0.004 | 0.004 | 0.004 |
| O | 0.002 | 0.002 | 0.004 | 0.003 | 0.004 | 0.005 |
| N | 0.002 | 0.002 | 0.002 | 0.005 | 0.003 | 0.001 |
| B [ppm] | 70 | 51 | 66 | 54 | 83 | 113 |
| Co | 0.0007 | 0.0007 | 0.0007 | 0.0004 | 0.0006 | 0.02 |

TABLE 2

| Categoty | | Reheating temp. [° C.] | Cooling type | Cooling rate [° C./s] | Tempering temp. [° C.] | Final micro-structure |
|---|---|---|---|---|---|---|
| Example | 1 | 950 | Quenching | 10 | 600 | 100% tempered martensite |
| | 2 | 900 | Quenching | 10 | 650 | 100% tempered martensite |
| | 3 | 850 | Quenching | 10 | 650 | 100% tempered martensite |
| | 4 | 850 | Quenching | 10 | 650 | 100% tempered martensite |
| | 5 | 850 | Quenching | 10 | 650 | 100% tempered martensite |
| | 6 | 850 | Quenching | 10 | 650 | 100% tempered martensite |
| | 7 | 850 | Quenching | 10 | 650 | 100% tempered martensite |
| Comp. Example | 1 | 950 | Quenching | 10 | 650 | 100% tempered martensite |
| | 2 | 950 | Quenching | 10 | 650 | 100% tempered martensite |
| | 3 | 850 | Quenching | 10 | 600 | 100% tempered martensite |
| | 4 | 850 | Quenching | 10 | 650 | 100% tempered martensite |
| | 5 | 950 | Quenching | 10 | 650 | 100% tempered martensite |
| | 6 | 950 | Normalizing | 1 | 600 | 40% tempered martensite + 60% tempered bainite |

As shown in Tables 1 and 2, all of Examples 1 to 7 satisfied the composition of the alloy steel proposed in the present invention, and Comparative Examples 1 to 5 did not satisfy the composition of the alloy steel proposed in the present invention. Comparative Example 6 had the same composition as in Example 1, but did not satisfy the heat treatment conditions suggested by the present invention. Therefore, Comparative Example 6 satisfied the alloy composition of the present invention, but did not satisfy the heat treatment conditions, and thus, 100 vol % of tempered martensite proposed in the present invention was not obtained as a constituent structure.

Test Example

Tests were performed to measure the tensile strength of Examples and Comparative Examples, notch tensile strength in an atmospheric environment, and notch tensile strength in a hydrogen environment. The results thereof are shown in Table 3 below.

Evaluation Method

For the alloy steel of each of Examples and Comparative Examples manufactured as above, JIS No. 4 sub-size rod-shaped tensile specimens (a total length of 120 mm, a parallel portion of 32 mm, and a gauge diameter of 6.25 mm) in the rolling direction were manufactured. Then, tensile strength was determined after performing a tensile test using the ASTM E8 standard, and was represented as an average value after three measurements. Also, in order to evaluate the notch tensile strength and hydrogen embrittlement resistance of each alloy steel, notch rod-shaped tensile specimens for hydrogen embrittlement testing in accordance with ASTM G142 in the rolling direction (a notch diameter of 3.6 mm, and a notch angle of 60°) were manufactured. Then, using the ASTM E8 standard, the ultimate tensile strength (UTS) of JIS No. 4 sub-size rod-shaped tensile specimens and notch rod-shaped tensile specimens was measured in a general ambient atmosphere. Also, in order to create an environment in which hydrogen was injected, a cell capable of holding a solution containing 1 N NaOH and 3 g/L $NH_4SCN$ was applied to the specimen, and hydrogen embrittlement resistance using a device capable of performing a slow strain rate tensile test (SSRT) was evaluated while injecting hydrogen into the specimen through continuous cathode hydrogen charging. The results thereof are shown in Table 3 below. The slow strain rate of the SSRT device was $1\times10^{-5}$/s.

Notch tensile strength ratio (MPa)×tensile strength (GPa)≥0.75 [Relation 1]

(In Relation 1, the notch tensile strength ratio is the value obtained by dividing the notch tensile strength in a hydrogen-charged atmosphere by the notch tensile strength in a general ambient atmosphere.)

TABLE 3

| Categoty | | Tensile strength [MPa] | Notch tensile strength in atmospheric environment [MPa] | Notch tensile strength in hydrogen environment [MPa] | Relation 1 | Remarks |
|---|---|---|---|---|---|---|
| Example | 1 | 1006 | 1746 | 1371 | 0.79 | Satisfying criteria of the present invention |
| | 2 | 1050 | 1865 | 1350 | 0.76 | Satisfying criteria of the present invention |
| | 3 | 1076 | 1880 | 1381 | 0.79 | Satisfying criteria of the present invention |
| | 4 | 1062 | 1871 | 1392 | 0.79 | Satisfying criteria of the present invention |
| | 5 | 1087 | 1911 | 1319 | 0.75 | Satisfying criteria of the present invention |
| | 6 | 1084 | 1853 | 1294 | 0.75 | Satisfying criteria of the present invention |
| | 7 | 1101 | 1888 | 1304 | 0.76 | Satisfying criteria of the present invention |
| Comp. Example | 1 | 933 | 1594 | 1111 | 0.65 | Not satisfying criteria of the present invention |
| | 2 | 924 | 1582 | 1096 | 0.64 | Not satisfying criteria of the present invention |
| | 3 | 1010 | 1773 | 1057 | 0.62 | Not satisfying criteria the present invention |
| | 4 | 1018 | 1737 | 1058 | 0.62 | Not satisfying criteria of the present invention |
| | 5 | 919 | 1571 | 1094 | 0.64 | Not satisfying criteria of the present invention |
| | 6 | 887 | 1514 | 990 | 0.58 | Not satisfying criteria of the present invention |

With regard to Relation 1, when this value was 0.75 or greater, hydrogen embrittlement resistance and tensile strength were excellent. As shown in Table 3, the tensile strength of Examples 1 to 7 was superior compared to Comparative Examples, and the value of Relation 1 was greater than 0.75, indicating that hydrogen embrittlement resistance was also excellent.

Therefore, in the alloy steel according to various exemplary embodiments of the present invention, boron (B) for greatly increasing hardenability even in a very small amount, cobalt (Co) for greatly enhancing strength, and various materials may be appropriately mixed to form 100 vol % of tempered martensite as a constituent structure, through which hydrogen embrittlement resistance and strength can be confirmed to be excellent.

The alloy steel according to various exemplary embodiments of the present invention includes 100 vol % of tempered martensite as a constituent structure, and has excellent hydrogen embrittlement resistance and strength by including both boron (B) for improving hardenability and strengthening grain boundaries and cobalt (Co) for realizing ultra-high strength, as well as materials capable of forming fine carbonitrides and trapping diffused hydrogen.

The effects of the present invention are not limited to the above-mentioned effects. It should be understood that the effects of the present invention include all effects that can be inferred from the description of the present invention.

Although specific embodiments of the present disclosure have been described with reference to the accompanying drawings, those skilled in the art will appreciate that the present disclosure may be embodied in other specific forms without changing the technical spirit or essential features thereof. Thus, the embodiments described above should be understood to be non-limiting and illustrative in every way.

What is claimed is:

1. An alloy steel composition, comprising:

0.2 wt % to 0.5 wt % of carbon (C),
0.1 wt % to 0.5 wt % of silicon (Si),
0.6 wt % to 0.9 wt % of manganese (Mn),
0.001 wt % to 0.03 wt % of phosphorus (P),
0.001 wt % to 0.01 wt % of sulfur (S),
0.001 wt % to 0.1 wt % of aluminum (Al),
0.001 wt % to 0.3 wt % of copper (Cu),
0.6 wt % to 2.5 wt % of chromium (Cr),
0.001 wt % to 0.5 wt % of nickel (Ni),
0.05 wt % to 1.0 wt % of molybdenum (Mo),
0.01 wt % to 0.3 wt % of vanadium (V),
0.01 wt % to 0.1 wt % of niobium (Nb), 0.01 wt % to 0.1 wt % of titanium (Ti),
0.001 wt % to 0.005 wt % of calcium (Ca),
0.001 wt % to 0.005 wt % of magnesium (Mg),
0.001 wt % to 0.01 wt % of oxygen (O),
0.001 wt % to 0.015 wt % of nitrogen (N),
0.0113 wt % to 0.0197 wt % of boron (B),
0.01 wt % to 0.1 wt % of cobalt (Co), and
a remainder of iron (Fe) and other unavoidable impurities,
all the wt % are based on the total weight of the alloy steel composition,
wherein the alloy steel has a microstructure comprising tempered martensite, and a fraction of the tempered martensite is 100 vol % at a temperature of 15° C. to 25° C. based on an area fraction, and
the alloy steel satisfies Relation 1 below:

$$\text{Notch tensile strength ratio (MPa)} \times \text{tensile strength (GPa)} \geq 0.75, \quad \text{[Relation 1]}$$

wherein in the Relation 1, the notch tensile strength ratio is a value obtained by dividing a notch tensile strength in a hydrogen-charged atmosphere by a notch tensile strength in a general ambient atmosphere.

2. The alloy steel of claim 1, wherein the alloy steel comprises precipitates comprising V(C,N), Nb(C,N), Ti(C,N), or combinations thereof, a number of the precipitates is 20 or greater per area ($\mu m^2$), and the precipitates have a diameter of 20 nm or less in a microstructure thereof.

3. The alloy steel of claim 1, wherein the alloy steel has a tensile strength of 1000 MPa or greater.

4. A vehicle comprising alloy steel composition of claim 1.

5. A method of manufacturing an alloy steel, comprising:
providing an alloy steel slab comprising, based on a total weight thereof, 0.2 wt % to 0.5 wt % of carbon (C), 0.1 wt % to 0.5 wt % of silicon (Si), 0.6 wt % to 0.9 wt % of manganese (Mn), 0.001 wt % to 0.03 wt % of phosphorus (P), 0.001 wt % to 0.01 wt % of sulfur (S), 0.001 wt % to 0.1 wt % of aluminum (Al), 0.001 wt % to 0.3 wt % of copper (Cu), 0.6 wt % to 2.5 wt % of chromium (Cr), 0.001 wt % to 0.5 wt % of nickel (Ni), 0.05 wt % to 1.0 wt % of molybdenum (Mo), 0.01 wt % to 0.3 wt % of vanadium (V), 0.01 wt % to 0.1 wt % of niobium (Nb), 0.01 wt % to 0.1 wt % of titanium (Ti), 0.001 wt % to 0.005 wt % of calcium (Ca), 0.001 wt % to 0.005 wt % of magnesium (Mg), 0.001 wt % to 0.01 wt % of oxygen (O), 0.001 wt % to 0.015 wt % of nitrogen (N), 0.0113 wt % to 0.0197 wt % of boron (B), 0.01 wt % to 0.1 wt % of cobalt (Co), and a remainder of iron (Fe) and other unavoidable impurities, wherein all the wt % are based on the total weight of the alloy steel composition;
primary heat treating the alloy steel stab;
manufacturing an alloy steel by secondary heat treating the alloy steel slab at a temperature equal to or higher than an A3 transformation point;
austenitizing the alloy steel by subjecting the alloy steel to cooling, third heat treating, and maintenance;
cooling the austenitized alloy steel; and
tempering the cooled alloy steel by fourth heat treating,
wherein the alloy steel has a microstructure comprising tempered martensite, and a fraction of the tempered martensite is 100 vol % at a temperature of 15° C. to 25° C. based on an area fraction, and
the alloy steel satisfies Relation 1 below:

$$\text{Notch tensile strength ratio (MPa)} \times \text{tensile strength (GPa)} \geq 0.75 \quad \text{[Relation 1]}$$

wherein in the Relation 1, the notch tensile strength ratio is a value obtained by dividing a notch tensile strength in a hydrogen-charged atmosphere by a notch tensile strength in a general ambient atmosphere.

6. The method of claim 5, wherein the cooling the austenitized alloy steel is performed through a quenching process.

7. The method of claim 4, further comprising performing cooling the alloy steel to a temperature of 15° C. to 25° C., after the tempering.

8. The method of claim 5, wherein the alloy steel comprises precipitates comprising V(C,N), Nb(C,N), Ti(C,N), or combinations thereof, a number of the precipitates is 20 or greater per area ($\mu m^2$), and the precipitates have a diameter of 20 nm or less in a microstructure thereof.

9. The method of claim 5, wherein the alloy steel has a tensile strength of 1000 MPa or greater.

* * * * *